US009121402B2

(12) United States Patent
Marshall et al.

(10) Patent No.: US 9,121,402 B2
(45) Date of Patent: Sep. 1, 2015

(54) PUMP BODY

(75) Inventors: William Marshall, Richmond, TX (US); Rod Shampine, Houston, TX (US); Edward Leugemors, Needville, TX (US); Hubertus V. Thomeer, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 515 days.

(21) Appl. No.: 13/393,620

(22) PCT Filed: Aug. 27, 2010

(86) PCT No.: PCT/IB2010/053867

§ 371 (c)(1),
(2), (4) Date: Oct. 18, 2012

(87) PCT Pub. No.: WO2011/027273

PCT Pub. Date: Mar. 10, 2011

(65) Prior Publication Data

US 2013/0042752 A1 Feb. 21, 2013

Related U.S. Application Data

(60) Provisional application No. 61/239,639, filed on Sep. 3, 2009.

(51) Int. Cl.

| | |
|---|---|
| ***F04B 1/14*** | (2006.01) |
| ***F04B 53/16*** | (2006.01) |
| ***F04B 47/00*** | (2006.01) |

(52) U.S. Cl.

CPC ..... *F04B 53/16* (2013.01); *F04B 1/143* (2013.01); *F04B 47/00* (2013.01)

(58) Field of Classification Search

CPC ..... B23P 6/02; F04B 1/143; F04B 1/145
USPC ..... 92/169.2, 169.1, 147, 146; 29/888.02, 29/888.021, 451, 525, 402.08; 417/539
See application file for complete search history.

(56) References Cited

U.S. PATENT DOCUMENTS 3,270,410 A * 9/1966 Salter et al. ..... 29/446
4,034,585 A * 7/1977 Straub ..... 72/53

(Continued)

FOREIGN PATENT DOCUMENTS

CN 1151446 A 6/1997
CN 2625885 Y 7/2004

(Continued)

OTHER PUBLICATIONS

Written Opinion mailed Mar. 12, 2013 for corresponding Singapore Application No. 201201525-1, filed on Aug. 27, 2010, 4 pages.

*Primary Examiner* — F. Daniel Lopez
(74) *Attorney, Agent, or Firm* — Jeffrey R. Anderson; Rachel E. Greene; Tim Curington

(57) ABSTRACT

A pump body is pre-compressed by expanding a displacement plug in a cavity to pre-compress a portion of a pump body comprising a piston bore, an inlet bore and an outlet bore spaced from said cavity, and connected in a pump assembly. A fluid pump assembly is made up of a plurality of pump bodies connected side by side between opposing end plates with a plurality of fasteners tightened to compress the pump bodies between the end plates, wherein each pump body comprises a piston bore, an inlet bore, an outlet bore and an expanded displacement plug in a cavity; and wherein the expanded displacement plug applies a pre-compressive force at the cavity on each of the pump bodies.

33 Claims, 4 Drawing Sheets

(56) References Cited

U.S. PATENT DOCUMENTS

| | | | | |
|---|---|---|---|---|
| 4,106,393 | A | 8/1978 | Dodson et al. | |
| 4,354,371 | A | 10/1982 | Johnson | |
| 4,771,627 | A * | 9/1988 | Speakman | 72/479 |
| 5,171,136 | A * | 12/1992 | Pacht | 417/539 |
| 5,778,759 | A | 7/1998 | Johnson | |
| 6,230,537 | B1 * | 5/2001 | Easterbrook | 72/334 |
| 6,419,459 | B1 | 7/2002 | Sibbing | |
| 6,711,928 | B1 * | 3/2004 | Easterbrook | 72/334 |
| 6,997,685 | B2 | 2/2006 | Lemmen | |
| 7,484,452 | B2 * | 2/2009 | Baxter et al. | 92/169.1 |
| 8,061,030 | B2 * | 11/2011 | Outhouse | 29/888.06 |
| 8,069,699 | B2 * | 12/2011 | Glenn et al. | 72/391.2 |
| 8,402,806 | B2 * | 3/2013 | Glenn et al. | 72/391.2 |
| 8,465,268 | B2 * | 6/2013 | Baxter et al. | 417/437 |
| 8,601,687 | B2 * | 12/2013 | Ochoa et al. | 29/888.042 |
| 8,763,229 | B2 * | 7/2014 | Reid et al. | 29/402.01 |
| 2004/0161351 | A1 * | 8/2004 | Forrest | 417/567 |
| 2007/0289351 | A1 * | 12/2007 | Glenn | 72/370.07 |
| 2008/0000065 | A1 | 1/2008 | Ganguly et al. | |
| 2008/0014106 | A1 | 1/2008 | Hofmann et al. | |
| 2008/0066518 | A1 * | 3/2008 | Glenn et al. | 72/370.07 |
| 2008/0298991 | A1 * | 12/2008 | Trubnikov | 92/146 |
| 2009/0092510 | A1 | 4/2009 | Williams et al. | |
| 2009/0101092 | A1 | 4/2009 | Ichinosawa et al. | |

FOREIGN PATENT DOCUMENTS

| | | |
|---|---|---|
| CN | 200999717 Y | 1/2008 |
| CN | 201074581 Y | 6/2008 |

* cited by examiner

PUMP BODY

CROSS REFERENCE TO RELATED APPLICATIONS

This application is entitled to the benefit of and claims priority to, U.S. Provisional Ser. No. 61/239,639, filed Sep. 3, 2009, the entire disclosure of which is incorporated herein by reference.

BACKGROUND OF THE INVENTION (1) Field of the Invention

The invention is related in general to wellsite surface equipment such as fracturing pumps and the like.

(2) Description of Related Art including information disclosed under 37 CFR 1.97 and 1.98

Multiplex reciprocating pumps are generally used to pump high pressure fracturing fluids downhole. Typically, the pumps that are used for this purpose have plunger sizes varying from about 9.5 cm (3.75 in.) to about 16.5 cm (6.5 in.) in diameter. These pumps typically have two sections: (a) a power end, the motor assembly that drives the pump plungers (the driveline and transmission are parts of the power end); and (b) a fluid end, the pump container that holds and discharges pressurized fluid.

In triplex pumps, the fluid end has three fluid cylinders. For the purpose of this document, the middle of these three cylinders is referred to as the central cylinder, and the remaining two cylinders are referred to as side cylinders. Similarly, a quintuplex pump has five fluid cylinders, including a middle cylinder and four side cylinders. A fluid end may comprise a single block having cylinders bored therein, known in the art as a monoblock fluid end.

The pumping cycle of the fluid end is composed of two stages: (a) a suction cycle: During this part of the cycle a piston moves outward in a packing bore, thereby lowering the fluid pressure in the fluid end. As the fluid pressure becomes lower than the pressure of the fluid in a suction pipe (typically 2-3 times the atmospheric pressure, approximately 0.28 MPa (40 psi)), the suction valve opens and the fluid end is filled with pumping fluid; and (b) a discharge cycle: During this cycle, the plunger moves forward in the packing bore, thereby progressively increasing the fluid pressure in the pump and closing the suction valve. At a fluid pressure slightly higher than the line pressure (which can range from as low as 13.8 MPa (2 Ksi) to as high as 145 MPa (21 Ksi)) the discharge valve opens, and the high pressure fluid flows through the discharge pipe.

Given a pumping frequency of 2 Hz, i.e., 2 pressure cycles per second, the fluid end body can experience a very large number of stress cycles within a relatively short operational lifespan. These stress cycles may induce fatigue failure of the fluid end. Fatigue involves a failure process where small cracks initiate at the free surface of a component under cyclic stress. The cracks may grow at a rate defined by the cyclic stress and the material properties until they are large enough to warrant failure of the component. Since fatigue cracks generally initiate at the surface, a strategy to counter such failure mechanism is to pre-load the surface.

Typically, this is done through an autofrettage process, which involves a mechanical pre-treatment of the fluid end in order to induce residual stresses at the internal free surfaces, i.e., the surfaces that are exposed to the fracturing fluid, also known as the fluid end cylinders. US 2008/000065 is an example of an autofrettage process for pretreating the fluid end cylinders of a multiplex pump. During autofrettage, the fluid end cylinders are exposed to high hydrostatic pressures. The pressure during autofrettage causes plastic yielding of the inner surfaces of the cylinder walls. Since the stress level decays across the wall thickness, the deformation of the outer surfaces of the walls is still elastic. When the hydrostatic pressure is removed, the outer surfaces of the walls tend to revert to their original configuration. However, the plastically deformed inner surfaces of the same walls constrain this deformation. As a result, the inner surfaces of the walls of the cylinders inherit a residual compressive stress. The effectiveness of the autofrettage process depends on the extent of the residual stress on the inner walls and their magnitude.

It remains desirable to provide improvements in wellsite surface equipment in efficiency, flexibility, reliability, and maintainability.

BRIEF SUMMARY OF THE INVENTION

The present invention in one embodiment applies pre-compressive forces in pump bodies, or selected portion(s) thereof, to inhibit initiation of fatigue cracks in the fluid end of a multiplex pump.

In one embodiment, a method comprises: expanding a displacement plug in a cavity to pre-compress a portion of a pump body comprising a piston bore, an inlet bore and an outlet bore spaced from said cavity; and connecting the pre-compressed pump body in a pump assembly. In an embodiment, the pre-compressed pump body portion is adjacent an intersection of the piston bore, inlet bore and outlet bore.

In an embodiment, the method comprises drilling the pump body to form the cavity as a bore. In an embodiment, the displacement plug comprises an interference fit pin having an outside diameter larger than an inside diameter of the cavity, and in a further embodiment, the displacement plug comprises an air relief port. In an embodiment, the displacement plug comprises a sleeve with a tapered inside diameter, wherein the sleeve is expanded by driving a similarly tapered pin into the sleeve. In another embodiment, the displacement plug comprises a pin with one or more cams to provide directional displacement at a surface of the cavity.

In an embodiment, the method further comprises forming raised surfaces on opposite exterior side surfaces of the pump body to apply a pre-compressive force at the raised surfaces upon the connection in the pump assembly.

In an embodiment, the method further comprises assembling a plurality of the pre-compressed pump bodies side by side between opposing end plates with a plurality of fasteners to form the pump assembly, wherein the fasteners are tightened to compress the pump bodies between the end plates. In an embodiment, the pre-compressed pump bodies further comprise raised surfaces on opposite exterior side surfaces thereof, wherein the raised surfaces engage with an adjacent end plate or an adjacent pump body; whereby the tightening of the fasteners applies a pre-compressive force at the raised surfaces on each of the pump bodies.

In an embodiment, the method further comprises autofrettaging the pump body. In an embodiment, the method further comprises placing a sleeve in the piston bore, inlet bore, outlet bore or a combination thereof and expanding the sleeve in place for use as a cylinder liner.

In an embodiment, the method further comprises operating the pump assembly to reciprocate a piston in the piston bore and cycle between relatively high and low fluid pressures in the inlet and outlet bores, wherein the pre-compressed pump body portion inhibits initiation of fatigue cracks. In an embodiment, the method further comprises disassembling the fluid pump assembly to remove the pump body when it exhibits fatigue crack initiation, and reassembling the fluid pump assembly with a replacement pump body.

In another embodiment, a fluid pump assembly comprises: a plurality of pump bodies connected side by side between opposing end plates with a plurality of fasteners tightened to compress the pump bodies between the end plates; wherein each pump body comprises a piston bore, an inlet bore, an outlet bore and an expanded displacement plug in a cavity; and wherein the expanded displacement plugs apply a pre-compressive force at the respective cavities on each of the pump bodies. In an embodiment, the pump bodies are autofrettaged.

In an embodiment, raised surfaces are provided on opposite exterior side surfaces of the pump bodies, wherein the raised surfaces engage with an adjacent end plate or the raised surface of an adjacent pump body, whereby the tightening of the fasteners applies a pre-compressive force at the raised surfaces on each of the pump bodies.

In an embodiment, the cavities are adjacent an intersection of the piston bore, the inlet bore, and the outlet bore. In an embodiment, the pre-compressive force extends the operational life of the assembly by reducing stress adjacent an intersection of the piston bore, the inlet bore, and the outlet bore. In an embodiment, a piston is reciprocatably disposed in the piston bore to cycle between relatively high and low fluid pressures in the inlet and outlet bores, wherein the pre-compressive force inhibits initiation of fatigue cracks.

In another embodiment, a method, to inhibit fatigue cracks in a fluid pump assembly comprising a plurality of pump bodies comprising a piston bore, an inlet bore and an outlet bore, comprises: (a) drilling bores on opposite exterior side surfaces of the plurality of pump bodies adjacent an intersection of the piston bore, inlet bore and outlet bore; (b) driving displacement plugs into the bores, wherein the displacement plugs are selected from the group consisting of interference fit pins, sleeves with tapered inside diameters, pins with one or more cams, and combinations thereof; (c) expanding the displacement plugs in the bores to apply a pre-compressive force adjacent the intersection; (d) forming the pump assembly by connecting the plurality of the pre-compressed pump bodies side by side between opposing end plates with a plurality of fasteners; and (e) tightening the fasteners to compress the plurality of pump bodies between the end plates. In an embodiment, the fatigue crack inhibition method further comprises autofrettaging the pump bodies.

In an embodiment, the fatigue crack inhibition method further comprises providing raised surfaces on opposite exterior side surfaces of the plurality of pump bodies, wherein the raised surfaces engage with an adjacent end plate or an adjacent pump body, whereby the tightening of the fasteners applies a pre-compressive force at the raised surfaces on each of the pump bodies. In an embodiment, the method further comprises disassembling the fluid pump assembly to remove one of the pump bodies exhibiting fatigue crack initiation, and reassembling the fluid pump assembly with a replacement pump body without fatigue cracks.

DETAILED DESCRIPTION OF THE INVENTION

Figure 3:
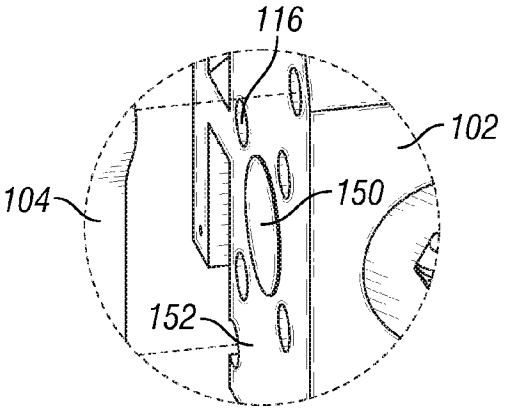
FIG. 3 is a view of the enlargement 3 of FIG. 2 showing a side surface of a pump body according to an embodiment of the invention.
Figure 1:
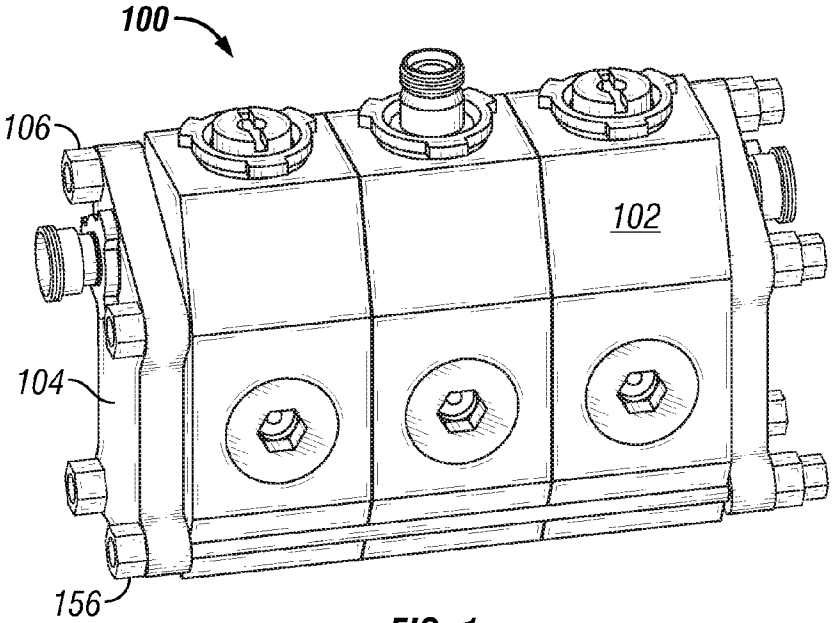
FIG. 1 is a fluid end perspective view of a triplex pump assembly according to an embodiment of the invention.
Figure 2:
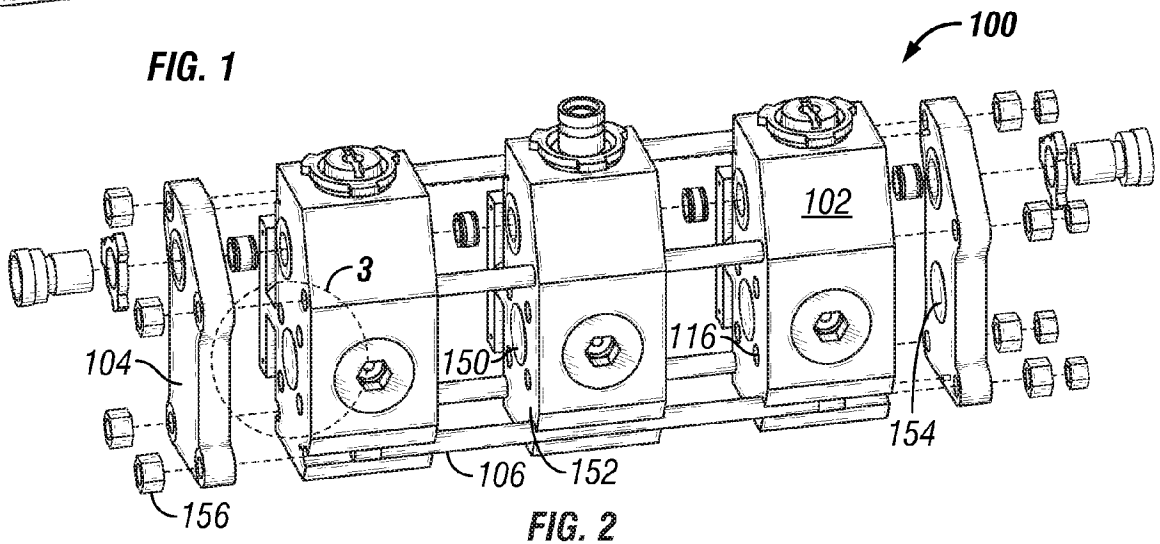
FIG. 2 is exploded view of the triplex pump assembly of FIG. 1 according to an embodiment of the invention.
Figure 5:
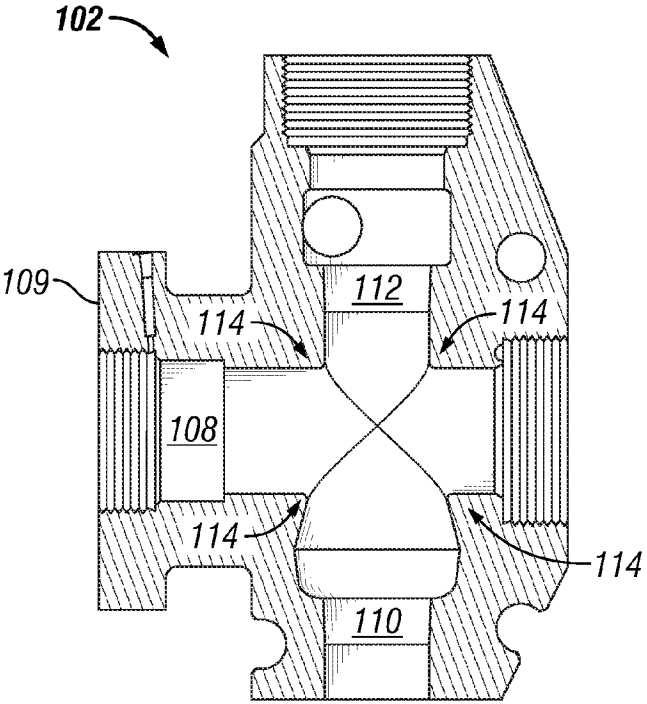
FIG. 5 is a side sectional view of the pump body of FIG. 4 as seen along the lines 5-5 according to an embodiment of the invention.
Figure 4:
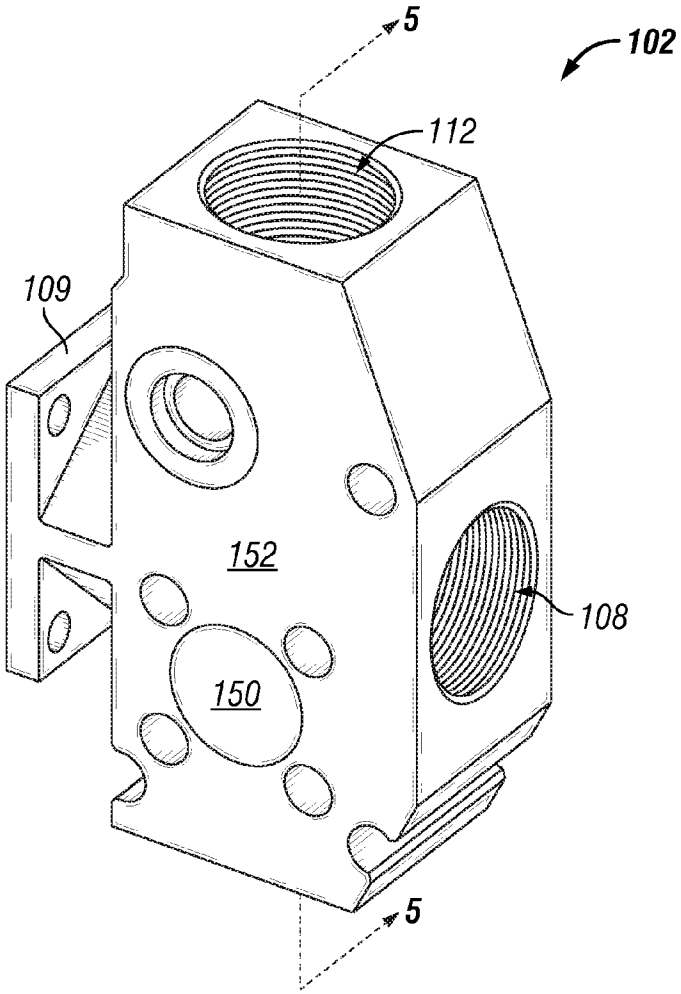
FIG. 4 is a perspective view of one of the pump body portions of the triplex pump assembly of FIGS. 1-3 according to an embodiment of the invention.

FIGS. 1-3 show the fluid end of the multiplex pump 100 including a plurality of pump bodies 102 secured between end plates 104 by means of fasteners 106. The end plates 104 are utilized in conjunction with the fasteners 106 to assemble the pump bodies 102 to form the pump 100. When the pump 100 is assembled, the three pump bodies 102 are assembled together using, for example, four large fasteners or tie rods 106 and the end plates 104 on opposing ends of the pump bodies 102. At least one of the tie rods 106 may extend through the pump bodies 102, while the other of the tie rods 106 may be external of the pump bodies 102. In addition to the triplex configuration of pump 100, those skilled in the art will appreciate that the pump bodies 102 may also be arranged in other configurations, such as a quintuplex pump assembly comprising five pump bodies 102, or the like As best seen in FIGS. 4-5, the pump body 102 has an internal passage or piston bore 108 which may be a through bore for receiving a pump plunger through the fluid end connection block 109. The connection block 109 provides a flange that may extend from the pump body 102 for guiding and attaching a power end to the pistons in the pump 100 and ultimately to a prime mover, such as a diesel engine or the like, as will be appreciated by those skilled in the art.

The pump body 102 may further define an inlet port 110 opposite an outlet port 112 substantially perpendicular to the piston bore 108, forming a crossbore. The bores 108, 110, and 112 of the pump body 102 may define substantially similar internal geometry as prior art monoblock fluid ends to provide similar volumetric performance. Those skilled in the art will appreciate that the pump body 100 may comprise bores formed in other configurations such as a T-shape, Y-shape, in-line, or other configurations. The material in the area adjacent the corners or edges 114 at the intersection of the piston bore 108 with the inlet and outlet ports 110, 112 defines areas of stress concentration that may be a concern for material fatigue failure. In addition to the stress concentration, the areas 114 are subject to the operational pressure cycling of the pump, which may further increase the risk of fatigue failure.

The pump bodies 102 may be pre-compressed in order to counteract the potential deformation of the areas 114 by expanding one or more displacement plugs 116 disposed at predetermined locations within the pump body 102. The plugs 116 are placed in, for example, a drilled bore or cavity formed in the body 102 and expanded with the use of an expansion tool and/or application of a radial force to the drilled bore or cavity, as will be appreciated by those skilled in the art. The bore formed in the body 102 may be cylindrical for a cylindrical plug 116, or tapered to accommodate a tapered plug 116 therein.

The expansion of the displacement plug 116 by application of a radial force induces a radial plastic yielding of the plug 116 and an elastic radial deformation of the surrounding material of the pump body 102. When the radial force is removed in one embodiment, the plug 116 contracts slightly radially inward due elastic relaxation, and the stresses in the adjacent areas are re-distributed. The radial deformation of the surrounding material of the pump body 102 does not completely vanish following the relaxation because the elastic radial deformation of the pump body is larger than the plastic radial deformation of the plug 116. As a result, the remaining stresses are re-distributed between the plug 116 and the body 102 after relaxation, generally in the form of compression, although tension is also possible in some regions, especially where there is geometric asymmetry or other anisotropy.

The pre-compressive force in an embodiment may also be hydraulically or pneumatically applied pressure, for example, via suitable sealed hydraulic or pneumatic connections to the cavity. The pre-compressive force in an embodiment may be applied by injecting a liquid or semi-liquid material into the bore that expands as it solidifies, the expansion of the material providing the pre-compressive force. In another embodiment where the plug 116 is permanently expanded or otherwise larger than the cavity in which it is received in the pump body 102, the plug 116 displaces the area around the plug, maintaining stresses against the abutting surface of the cavity.

Determining the location of the bore or cavity for the plug 116, such as by placing the predetermined locations at areas adjacent or near the areas 114, allows for selective control of the stress patterns inside the pump body 102. The pre-compressive force is believed to counteract the potential deformation of the areas 114 due to the operational pressure encountered by the bores 108, 110, 112. By counteracting the potential deformation due to operational pressure, stress on the areas 114 of the pump body 102 is reduced, thereby increasing the overall life of the pump body 102 by reducing the likelihood of fatigue failures.

Figure 6:
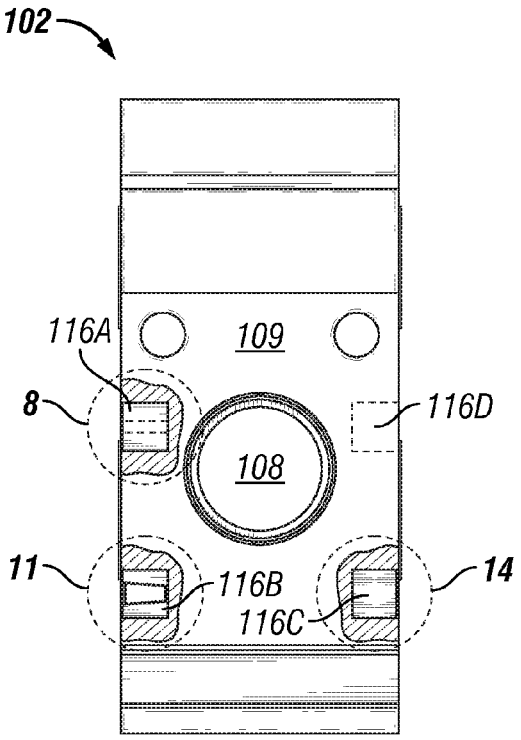
FIG. 6 is an end view of a pump body, partially cut away, according to an embodiment of the invention.
Figure 7:
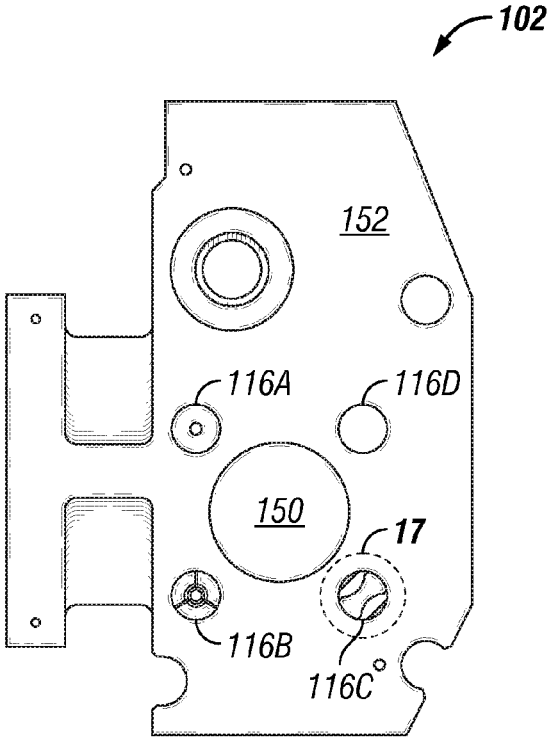
FIG. 7 is a side elevation view of the pump body of FIG. 6 according to an embodiment of the invention.

With reference to FIGS. 6 and 7 the pump body 102 comprises four displacement plugs 116A, 116B, 116C, 116D positioned in bores formed in the sides of the pump body 102. Each of the plugs 116A-116D is disposed adjacent a corner area 114 (see FIG. 5) at or near the intersection of the bores 108, 110, 112. If desired, a raised surface 150 may also be provided on the side surface of the pump body 102, as discussed in more detail below. In an embodiment, the plugs 116A-116D are arranged coaxially around the raised surface 150 at an even spacing.

Figure 8:
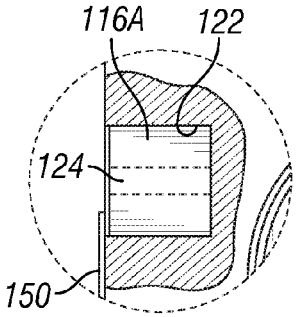
FIG. 8 is a view of the enlargement 8 of FIG. 6 according to an embodiment of the invention.
Figure 9:
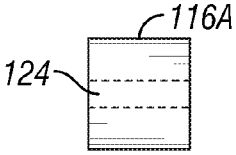
FIG. 9 is a side perspective view of the displacement plug from FIG. 8 according to an embodiment of the invention.
Figure 10:
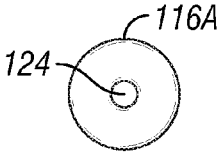
FIG. 10 is an end view of the displacement plug from FIGS. 8 and 9 according to an embodiment of the invention.

In one embodiment, one or more of the plugs 116 comprises a friction fit plug such as plug 116A as seen in FIGS. 8-10. For example, the plug 116A has an outside diameter that is normally slightly larger than the bore 122, by an amount corresponding to the displacement desired, and may include a central channel 124 to allow air to escape and/or to supply fluid in a hydroforming process, as will be appreciated by those skilled in the art. If desired, the plug 116A can be cooled and/or the pump body 102, at least near the bore 122, can be heated to facilitate insertion of the plug 116A in the bore 122 and/or to provide relative expansion of the plug 116A upon reaching thermal equilibrium following insertion. Additionally or alternatively, the plug 116A can be provided with a chamfered end and/or the bore 122 with a flared opening, to facilitate initiation of insertion into the bore 122 by a hammer or punch.

Figure 11:
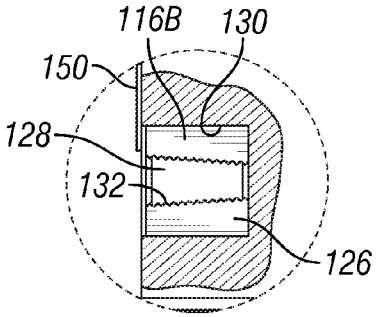
FIG. 11 is a view of the enlargement 11 of FIG. 6 according to an embodiment of the invention.
Figure 12:
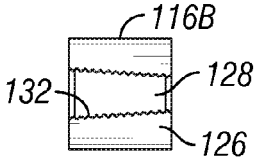
FIG. 12 is a side perspective view of the displacement plug from FIG. 11 according to an embodiment of the invention.
Figure 13:
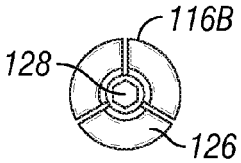
FIG. 13 is an end view of the displacement plug from FIGS. 11 and 12 according to an embodiment of the invention.

In an embodiment, one or more of the plugs 116 comprises a tapered sleeve plug 116B as seen in FIGS. 11-13. For example, the plug 116B comprises a sleeve 126 and a pin 128, wherein the sleeve 126 has an outside diameter matching the inside diameter of the bore 130 and a tapered internal surface 132 matching the taper of an external surface of the pin 128, wherein the diameter of the small end of the pin 128 is slightly larger than the minimum diameter of the surface 132. The plug 116B is expanded in the bore 130 by driving the pin 126 with a hammer or punch, for example.

Figure 17:
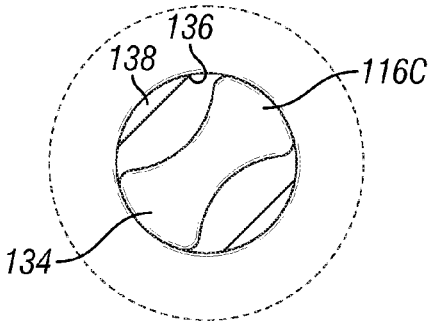
FIG. 17 is an enlarged perspective view of the displacement plug from FIGS. 14 to 16 in a bore with a projection cam formed in a surface of a pump body according to an embodiment of the invention.
Figure 14:
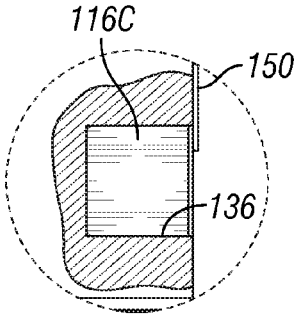
FIG. 14 is a view of the enlargement 14 of FIG. 6 according to an embodiment of the invention.
Figure 15:
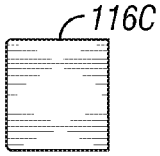
FIG. 15 is a side perspective view of the displacement plug from FIG. 14 according to an embodiment of the invention.
Figure 16:
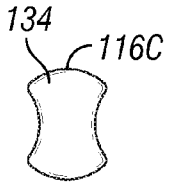
FIG. 16 is an end view of the displacement plug from FIGS. 14 and 15 according to an embodiment of the invention.

For an embodiment wherein anisotropic pre-compressive stress is desired near the plug 116, as seen in FIGS. 14-16, the plug 116C may comprise a modified outside surface with a cam-like projection 134 or the like for selectively controlling the stress patterns in the pump body 102 when the plug 116C is deformed therein. The plug 116C may be a friction fit plug as described above wherein the projection 134 is slightly larger than the bore 136, such as by rotation of the plug 116C to engage a projection 138 within the bore 136, as best seen in FIG. 17.

The pre-compressive force may also be applied by pre-tensioning or post-tensioning a plug disposed within a cavity formed in the pump body 102 in a manner similar to pre-tensioning and post-tensioning concrete slabs or the like. The plug 116 may be utilized in a way such that the pre-compressive force comprises both an axial load (such as along the longitudinal axis of the fasteners 106, and a radial load within a cavity in the pump body 102, thereby enabling selective application of the pre-compressive force within the body 102 via, for example, an interference fit, via rotation of the plug 116C to engage the cam-like projection 134 noted above, or the like.

Those skilled in the art will appreciate that the pre-compressive force may be applied along an axis parallel to the fasteners 106, perpendicular to the fasteners 106 or along any axis that will provide a pre-compressive force to a predetermined area. The fasteners 106, for example, may comprise a modified outer surface with a cam-like projection or the like for selectively controlling the stress patterns in the pump body 102, such as by rotation of the fastener 106 to engage the projection with the body 102 during assembly of the pump assembly 112 and thereby create the pre-compressive force within the body 102. The bores through which the fasteners 106 pass may comprise a reduced diameter portion or fasteners 106 may comprise an increased diameter portion for selectively controlling the stress patterns in the pump body 102 via an interference fit between the bores within the pump body 102 and the fasteners 106 to create the pre-compressive force within the pump body 102.

In one embodiment, a sleeve may be placed, for example, in the piston bore 104, the inlet port 106 or the outlet port 108 and expanded into place for use as a cylinder liner or the like.

The sleeve may be placed in the bore 104 or ports 106 or 108 by the use of a hydroforming process, as will be appreciated by those skilled in the art.

In one embodiment, a raised surface 150 extends from an exterior surface 152 of the pump body 102, best seen in FIGS. 2-4 and 7. The raised surface 150 may extend a predetermined distance from the exterior surface 152 and may define a predetermined area on the exterior surface 152. While illustrated as circular in shape, the raised surface 150 may be formed in any suitable shape. The end plates 104 may further comprise a raised surface 154, best seen in FIG. 2, similar to the surface 150 on the pump body 102 for engaging with the raised surfaces 150 of the pump body 102 during assembly.

The tie rods or fasteners 106 may be tightened utilizing a hydraulic tensioner, as will be appreciated by those skilled in the art. The tensioner may have its hydraulic power provided by the outlet flow of the pump 100 itself. The hydraulic tensioner may provide a constant tension or a variable tension on the tie rods 106, depending on the requirements of the operation of the assembly 100. As the tie rods 106 are tightened, via threaded nuts 156 or the like, to assemble the pump 100, the raised surfaces 150 on the pump body 102 and raised surfaces 154 on the end plates 104 engage with one another to provide an additional pre-compressive force to the areas 114 of the pump body 102 adjacent the intersection of the bores 108, 110, and 112. The pre-compressive force is believed to counteract the potential deformation of the areas 114 due to the operational pressure encountered by the bores 108, 110, and 112. By counteracting the potential deformation due to operational pressure, stress on the areas 114 of the pump body 102 is reduced, thereby increasing the overall life of the pump bodies by reducing the likelihood of fatigue failures. Those skilled in the art will appreciate that the torque of the fasteners 106 and the raised surfaces 150 and 154 cooperate, together with the expanded plugs 116, to provide the pre-compressive force on the areas 114.

Due to the substantially identical profiles of the plurality of pump bodies 102, the pump bodies 102 may be advantageously interchanged between the middle and side pump bodies of the pump 100, providing advantages in assembly, disassembly, and maintenance, as will be appreciated by those skilled in the art. In operation, if one of the pump bodies 102 of the pump 100 fails, only the failed one of the pump bodies 102 need be replaced, reducing the potential overall downtime of a pump 100 and its associated monetary impact. The pump bodies 102 are smaller than a typical monoblock fluid end having a single body with a plurality of cylinder bores machined therein and therefore provide greater ease of manufacturability due to the reduced size of forging, castings, etc.

While illustrated as comprising three of the pump bodies 102, the pump 100 may be formed in different configurations, such as by separating or segmenting each of the pump bodies 102 further, by segmenting each of the pump bodies 102 in equal halves along an axis that is substantially perpendicular to the surfaces 152, or by any suitable segmentation.

The preceding description has been presented with reference to present embodiments. Persons skilled in the art and technology to which this disclosure pertains will appreciate that alterations and changes in the described structures and methods of operation can be practiced without meaningfully departing from the principle, and scope of this invention. Accordingly, the foregoing description should not be read as pertaining only to the precise structures described and shown in the accompanying drawings, but rather should be read as consistent with and as support for the following claims, which are to have their fullest and fairest scope.

We claim:

1. A method, comprising:

radially expanding a displacement plug in a cavity to pre-compress a portion of a pump body comprising a piston bore, an inlet bore and an outlet bare spaced from said cavity; and connecting the pre-compressed pump body in a pump assembly.

2. The method of claim 1, wherein the pre-compressed pump body portion is adjacent an intersection of the piston bore, inlet bore and outlet bore.

3. The method of claim 1 or 2, comprising drilling the pump body to form the cavity as a bore.

4. The method of claim 1, wherein the displacement plug comprises an interference fit pin having an outside diameter larger than an inside diameter of the cavity.

5. The method of claim 4, wherein the displacement plug comprises an air relief port.

6. The method of claim 1, wherein the displacement plug comprises a sleeve with a tapered inside diameter, wherein the sleeve is expanded by driving a similarly tapered pin into the sleeve.

7. The method of claim 1, wherein the displacement plug comprises a pin with one or more cams to provide directional displacement at a surface of the cavity.

8. The method of claim 1, further comprising forming raised surfaces on opposite exterior side surfaces of the pump body to apply a pre-compressive force at the raised surfaces upon the connection in the pump assembly.

9. The method of claim 1, further comprising assembling a plurality of the pre-compressed pump bodies side by side between opposing end plates with a plurality of fasteners to form the pump assembly, wherein the fasteners are tightened to compress the pump bodies between the end plates.

10. The method of claim 9, wherein the pre-compressed pump bodies further comprise raised surfaces on opposite exterior side surfaces thereof, wherein the raised surfaces engage with an adjacent end plate or an adjacent pump body; whereby the tightening of the fasteners applies a pre-compressive force at the raised surfaces on each of the pump bodies.

11. The method of claim 1, further comprising autofrettaging the pump body.

12. The method of claim 1, further comprising placing a sleeve in the piston bore, inlet bore, outlet bore or a combination thereof and expanding the sleeve in place for use as a cylinder liner.

13. The method of claim 1, further comprising operating the pump assembly to reciprocate a piston in the piston bore and cycle between relatively high and low fluid pressures in the inlet and outlet bores, wherein the pre-compressed pump body portion inhibits initiation of fatigue cracks.

14. The method of claim 1, further comprising disassembling the fluid pump assembly to remove the pump body when it exhibits fatigue crack initiation, and reassembling the fluid pump assembly with a replacement pump body.

15. A fluid pump assembly, comprising:

a plurality of pump bodies connected side by side between opposing end plates with a plurality of fasteners tightened to compress the pump bodies between the end plates;

wherein each pump body comprises a piston bore, an inlet bore, an outlet bore and a radially expanded displacement plug in a cavity; and wherein the radially expanded displacement plug applies a pre-compressive force at the cavity on each of the pump bodies.

16. The fluid pump assembly of claim 15, wherein the cavity comprises a bore drilled in the pump body and the displacement plug comprises an interference fit pin having an outside diameter larger than an inside diameter of the cavity.

17. The fluid pump assembly of claim 15, wherein the cavity comprises a bore drilled in the pump body and the displacement plug comprises a sleeve with a tapered inside diameter, wherein the sleeve is expanded by driving a similarly tapered pin into the sleeve.

18. The fluid pump assembly of claim 15, wherein the cavity comprises a bore drilled in the pump body and the displacement plug comprises a pin with one or more cams to provide directional displacement at a surface of the cavity.

19. The fluid pump assembly of claim 15, wherein the pump bodies are autofrettaged.

20. The fluid pump assembly of claim 19, wherein the cavities are adjacent an intersection of the piston bore, the inlet bore, and the outlet bore.

21. The fluid pump assembly of claim 20, wherein the pre-compressive force extends the operational life of the assembly by reducing stress adjacent an intersection of the piston bore, the inlet bore, and the outlet bore.

22. The fluid pump assembly of claim 15, further comprising raised surfaces on opposite exterior side surfaces of the pump bodies, wherein the raised surfaces engage with an adjacent end plate or the raised surface of an adjacent pump body, whereby the tightening of the fasteners applies a pre-compressive force at the raised surfaces on each of the pump bodies.

23. The fluid pump assembly of claim 22, wherein the cavities are adjacent an intersection of the piston bore, the inlet bore, and the outlet bore.

24. The fluid pump assembly of claim 23, wherein the pre-compressive force extends the operational life of the assembly by reducing stress adjacent an intersection of the piston bore, the inlet bore, and the outlet bore.

25. The fluid pump assembly of claim 15, wherein the cavities are adjacent an intersection of the piston bore, the inlet bore, and the outlet bore.

26. The fluid pump assembly of claim 25, wherein the pre-compressive force extends the operational life of the assembly by reducing stress adjacent an intersection of the piston bore, the inlet bore, and the outlet bore.

27. The fluid pump assembly of claim 15, wherein the pre-compressive force extends the operational life of the assembly by reducing stress adjacent an intersection of the piston bore, the inlet bore, and the outlet bore.

28. The fluid pump assembly of claim 15, further comprising a piston reciprocatably disposed in the piston bore to cycle between relatively high and low fluid pressures in the inlet and outlet bores, wherein the pre-compressive force inhibits initiation of fatigue cracks.

29. A method to inhibit fatigue cracks in a fluid pump assembly comprising a plurality of pump bodies comprising a piston bore, an inlet bore and an outlet bore, comprising:

drilling bores on opposite exterior side surfaces of the plurality of pump bodies adjacent an intersection of the piston bore, inlet bore and outlet bore;

driving displacement plugs into the bores, wherein the displacement plugs are selected from the group consisting of interference fit pins, sleeves with tapered inside diameters, pins with one or more cams, and combinations thereof;

expanding the displacement plugs in the bores to apply a pre-compressive force adjacent the intersection;

forming the pump assembly by connecting the plurality of the pre-compressed pump bodies side by side between opposing end plates with a plurality of fasteners; and tightening the fasteners to compress the plurality of pump bodies between the end plates.

30. The method of claim 29, further comprising autofrettaging the pump bodies.

31. The method of claim 29, further comprising providing raised surfaces on opposite exterior side surfaces of the plurality of pump bodies, wherein the raised surfaces engage with an adjacent end plate or an adjacent pump body, whereby the tightening of the fasteners applies a pre-compressive force at the raised surfaces on each of the pump bodies.

32. The method of claim 31, further comprising disassembling the fluid pump assembly to remove one of the pump bodies exhibiting fatigue crack initiation, and reassembling the fluid pump assembly with a replacement pump body without fatigue cracks.

33. The method of claim 29, further comprising disassembling the fluid pump assembly to remove one of the pump bodies exhibiting fatigue crack initiation, and reassembling the fluid pump assembly with a replacement pump body without fatigue cracks.

* * * * *